US012474071B2

(12) United States Patent
Vallery et al.

(10) Patent No.: US 12,474,071 B2
(45) Date of Patent: Nov. 18, 2025

(54) ROOF VENTILATION FOR A TILE ROOF

(71) Applicant: MARCO INDUSTRIES INC., Tulsa, OK (US)

(72) Inventors: Christopher Vallery, Tulsa, OK (US); Robert P. Harris, Tulsa, OK (US); Robert C. Carnick, Tulsa, OK (US); Neil Westgarth, Tulsa, OK (US); George Allaster, Tulsa, OK (US)

(73) Assignee: MARCO INDUSTRIES INC., Tulsa, OK (US)

( * ) Notice: Subject to any disclaimer, the term of this patent is extended or adjusted under 35 U.S.C. 154(b) by 385 days.

(21) Appl. No.: 18/104,562

(22) Filed: Feb. 1, 2023

(65) Prior Publication Data

US 2023/0243528 A1 Aug. 3, 2023

Related U.S. Application Data

(60) Provisional application No. 63/428,840, filed on Nov. 30, 2022, provisional application No. 63/305,389, filed on Feb. 1, 2022.

(51) Int. Cl.
*F24F 7/02* (2006.01)

(52) U.S. Cl.
CPC ..... *F24F 7/02* (2013.01)

(58) Field of Classification Search
CPC ..... F24F 7/02; E04D 13/174
See application file for complete search history.

(56) References Cited

U.S. PATENT DOCUMENTS

| | | | |
|---|---|---|---|
| 429,937 | A | 6/1890 | Mitchell |
| 2,318,820 | A | 5/1943 | Voigt et al. |
| 2,470,201 | A | 5/1949 | Werner |
| 2,490,220 | A | 12/1949 | Leslie |
| 3,492,192 | A | 1/1970 | Bullard |
| 3,884,009 | A | 5/1975 | Frohlich et al. |
| 3,949,657 | A | 4/1976 | Sells |
| 4,024,685 | A | 5/1977 | Aarons |
| 4,189,886 | A | 2/1980 | Fohlich et al. |
| 4,280,399 | A | 7/1981 | Cunning |
| 4,325,290 | A | 4/1982 | Wolfert |
| 4,545,291 | A | 10/1985 | Kutsch et al. |

(Continued)

FOREIGN PATENT DOCUMENTS

| | | | | |
|---|---|---|---|---|
| CN | 212984379 U | * | 4/2021 | |
| DE | 19643591 A1 | * | 4/1998 | ..... E04D 1/36 |

(Continued)

OTHER PUBLICATIONS

Korean Intellectual Property Office, "PCT International Search Report and Written Opinion," mailed Jul. 23, 2014 for PCT Application No. PCT/US2014/027897, 12 pages.

(Continued)

*Primary Examiner* — Fatima N Farokhrooz
(74) *Attorney, Agent, or Firm* — Dorsey & Whitney LLP

(57) ABSTRACT

A ventilation system for a tile roof includes an elongated vent body defining a channel and securing features integrated with and extending from each side of the elongated vent body, where the securing features are configured to engage with a roof deck of the tile roof. The ventilation system further includes a support member received in the channel of the elongated vent body.

21 Claims, 8 Drawing Sheets

(56) References Cited

U.S. PATENT DOCUMENTS 4,545,292 A 10/1985 Inokawa et al.
4,558,637 A 12/1985 Mason
4,570,396 A 2/1986 Struben
4,598,505 A 7/1986 McGown
4,754,589 A 7/1988 Leth
4,788,801 A * 12/1988 Jones ..... E04D 13/174 52/57
4,843,953 A 7/1989 Sells
4,876,950 A 10/1989 Rudeen
4,924,761 A 5/1990 MacLeod et al.
4,957,037 A 9/1990 Tubbesing et al.
4,995,308 A 2/1991 Waggoner
5,002,816 A 3/1991 Hofmann et al.
5,009,149 A 4/1991 MacLeod et al.
5,022,203 A 6/1991 Boyd
5,050,489 A 9/1991 Mankowski
5,060,431 A 10/1991 Macleod et al.
5,092,225 A 3/1992 Sells
5,095,810 A 3/1992 Robinson
5,122,095 A 6/1992 Wolfert
5,167,579 A 12/1992 Rotter
5,174,076 A 12/1992 Schiedegger et al.
5,288,269 A 2/1994 Hansen
5,304,095 A 4/1994 Morris
5,326,318 A * 7/1994 Rotter ..... E04D 13/174 454/365
5,328,407 A 7/1994 Sells
5,331,783 A 7/1994 Kasner et al.
5,332,393 A 7/1994 Godl
5,352,154 A 10/1994 Rotter et al.
5,353,154 A 10/1994 Lutz et al.
5,425,672 A 6/1995 Rotter
5,427,571 A 6/1995 Sells
5,439,417 A 8/1995 Sells
5,458,538 A 10/1995 MacLeod et al.
5,473,847 A 12/1995 Crookston
5,542,882 A 8/1996 Sells
5,561,953 A 10/1996 Rotter
5,593,348 A * 1/1997 Rickert ..... E04D 1/36 454/365
5,603,657 A 2/1997 Sells
5,803,805 A 9/1998 Sells
5,816,014 A 10/1998 Tzeng et al.
5,826,383 A 10/1998 Garrison
5,867,956 A 2/1999 Gregory et al.
5,921,863 A 7/1999 Sells
5,924,925 A 7/1999 Nystrom
5,947,817 A 9/1999 Morris et al.
6,077,159 A 6/2000 Clayton
6,079,166 A 6/2000 Mason et al.
6,125,602 A 10/2000 Freiborg et al.
6,149,517 A 11/2000 Hansen
6,267,668 B1 7/2001 Morris
6,298,613 B1 10/2001 Coulton et al.
6,308,472 B1 10/2001 Coulton et al.
6,418,678 B2 7/2002 Rotter
6,450,882 B1 9/2002 Morris et al.
6,458,029 B2 10/2002 Morris
6,491,581 B1 12/2002 Mankowski
6,599,184 B2 7/2003 Morris
6,647,675 B1 11/2003 Castellanos
6,662,510 B2 12/2003 Rotter
6,773,342 B2 8/2004 Rotter
6,780,099 B1 8/2004 Harper
6,944,997 B2 9/2005 Verkamp
6,966,156 B2 * 11/2005 Dixon ..... E04D 13/174 52/302.1
6,997,800 B1 * 2/2006 Kohler ..... E04D 13/178 454/365
7,566,265 B2 * 7/2009 Reeves ..... E04D 13/174 454/365
7,594,363 B2 9/2009 Polumbus et al.
8,024,897 B2 9/2011 Polumbus et al.
8,037,643 B1 * 10/2011 Anderson ..... E04D 12/008 248/237
8,083,576 B2 12/2011 Rotter
8,276,331 B2 10/2012 Polumbus et al.
8,302,352 B2 11/2012 Bahn et al.
8,790,167 B2 7/2014 Holland et al.
9,151,059 B2 10/2015 Pavlansky et al.
10,590,654 B2 3/2020 Polumbus et al.
11,739,532 B1 8/2023 Robida
2002/0032000 A1 3/2002 Lawless, III et al.
2002/0194799 A1 12/2002 Sharp et al.
2003/0022618 A1 1/2003 Miller
2003/0051419 A1 3/2003 Suzuki
2003/0077999 A1 4/2003 Mankowski
2004/0000101 A1 * 1/2004 Dixon ..... E04D 13/174 52/57
2004/0137185 A1 7/2004 Sieber et al.
2005/0048912 A1 * 3/2005 Rotter ..... E04D 13/174 454/365
2005/0106360 A1 5/2005 Johnston et al.
2005/0202779 A1 9/2005 Smith
2005/0233691 A1 10/2005 Horton
2005/0239392 A1 * 10/2005 Sells ..... F24F 7/02 454/165
2005/0241248 A1 11/2005 Ridenour
2006/0019598 A1 * 1/2006 Rotter ..... E04D 13/176 454/365
2006/0116069 A1 * 6/2006 Urbanski ..... E04D 13/174 454/365
2006/0121845 A1 6/2006 Sells
2007/0072539 A1 3/2007 Sells
2007/0093197 A1 4/2007 Shah
2009/0113823 A1 5/2009 Osborne
2009/0298370 A1 12/2009 Rock
2016/0138270 A1 5/2016 Rotter
2017/0146253 A1 5/2017 Mantyla et al.
2021/0238858 A1 8/2021 Polumbus et al.
2023/0228092 A1 7/2023 Robida
2024/0003560 A1 1/2024 Allaster et al.
2024/0175588 A1 5/2024 Harris et al.
2024/0183549 A1 6/2024 Harris et al.
2024/0183550 A1 6/2024 Vallery et al.

FOREIGN PATENT DOCUMENTS

FR 2966228 A1 * 4/2012 ..... F24J 2/045
JP 07-109797 4/1995
JP H07109797 A * 4/1995
JP 07157960 A 6/1995
JP 2012087618 A * 5/2012
WO 95/21975 A1 8/1995
WO 97/32940 9/1997
WO 02092930 A1 11/2002
WO 2014143787 A1 9/2014

OTHER PUBLICATIONS

Canadian Intellectual Property Office, "Third Office Action," mailed Jan. 27, 2015, for Canadian Patent Application No. 2,718,316, 10 pages.
Canadian Intellectual Property Office, "First Office Action," mailed Jun. 12, 2012, for Canadian Application No. 2,718,316, 4 pages.
Canadian Intellectual Property Office, "Second Office Action," mailed Mar. 21, 2013, for Canadian Application No. 2,718,316, 5 pages.
European Patent Office, "Communication pursuant to Rules 70(2) and 70a(2) EPC," mailed Jul. 11, 2013, for European Application No. 11748245.5, 8 pages.
European Patent Office, "Supplementary European Search Report," mailed Jun. 24, 2013, for European Application No. 11748245.5, 8 pages.
European Patent Office, "European Search Report," mailed Nov. 11, 2024, for European Application No. 24185162.5, 14 pages.

* cited by examiner

ROOF VENTILATION FOR A TILE ROOF

CROSS-REFERENCE TO RELATED APPLICATIONS

This application claims priority to U.S. Provisional Patent Application No. 63/305,389, filed Feb. 1, 2022, entitled "ROOF VENTILATION FOR A TILE ROOF" and U.S. Provisional Patent Application No. 63/428,840, filed Nov. 30, 2022, entitled "ROOF VENTILATION FOR A TILE ROOF," both of which are incorporated by reference herein in their entirety and for all purposes.

FIELD

This application relates to a tile roof ridge vent and the method of its use and construction.

BACKGROUND

Ventilation of a tile roof ridge is known. Current solutions, such as a tile ridge vent, use mortar for installing separate injection molded pieces. Further current solutions often use individual brackets to separately secure a ridge board above the ridge slot.

SUMMARY

An example ventilation system for a tile roof disclosed herein includes an elongated vent body defining a channel and securing features integrated with and extending from each side of the elongated vent body, where the securing features are configured to engage with a roof deck of the tile roof. The ventilation system further includes a support member received in the channel of the elongated vent body.

In various examples, the securing features may comprise a plurality of integral tabs extending from each side of the elongated vent body.

In various examples, the plurality of integral tabs may include three tabs extending from each side of the body and each configured to receive a fastener to engage with the roof deck.

In various examples, the elongated body may be a single piece construction.

In various examples, the ventilation system may further include a nonwoven material engaged with the elongated vent body. The nonwoven material may be spaced away from the securing features.

In various examples, the ventilation system may further include one or more apertures defined in the elongated vent body.

In various examples, the ventilation system may be at least partially concealed by a roof tile and a roof cap.

In various examples, the ventilation system may be completely concealed by a roof tile and a roof cap.

In various examples, the support member may be a wood or a composite material.

An example method of manufacturing a ventilation system for a tile roof is disclosed herein. The method includes deforming a single piece of material to form an elongated vent body defining a channel and forming, from the single piece of material, securing features extending from each side of the elongated vent body, where the securing features are configured to engage with a roof deck. The method further includes placing a support member within the channel of the elongated vent body.

In various examples, forming the securing features may include bending the single piece of material to create respective flanges extending from the elongated vent body.

In various examples, the securing features may include a plurality of integral tabs extending from each side of the body and the method may further include removing material from the respective flanges, leaving the plurality of integral tabs extending from each side of the elongated vent body.

In various examples, the method may further include bending each of the plurality of integral tabs at an angle from the elongated vent body, where the angle is determined based on a pitch of the tile roof.

In various examples, the method may further include providing a plurality of apertures in the respective flanges, where the plurality of apertures are configured to receive a respective plurality of fasteners to engage the respective flanges with the roof deck.

In various examples, the method may further include determining a depth of the channel based at least on characteristics of one or more tiles of the tile roof, where deforming the single piece of material to form an elongated vent body includes forming the channel based on the depth of the channel.

An example ventilation system for a tile roof disclosed herein includes an elongated vent body defining a channel and a plurality of integral tabs extending from each side of the elongated vent body. The plurality of integral tabs and the elongated vent body are formed from a single piece of material. The ventilation system further includes a support member received in the channel.

In various examples, the ventilation system may further include one or more apertures defined in the vent body.

In various examples, each of the plurality of integral tabs may include an aperture configured to receive a fastener for securing the ventilation system to a roof deck of the tile roof.

In various examples, the ventilation system may further include a nonwoven material engaged with the elongated vent body.

Additional embodiments and features are set forth in part in the description that follows, and will become apparent to those skilled in the art upon examination of the specification and may be learned by the practice of the disclosed subject matter. A further understanding of the nature and advantages of the present disclosure may be realized by reference to the remaining portions of the specification and the drawings, which form a part of this disclosure. One of skill in the art will understand that each of the various aspects and features of the disclosure may advantageously be used separately in some instances, or in combination with other aspects and features of the disclosure in other instances.

BRIEF DESCRIPTION OF THE DRAWINGS

The description will be more fully understood with reference to the following figures in which components are not drawn to scale, which are presented as various examples of the present disclosure and should not be construed as a complete recitation of the scope of the disclosure, characterized in that.

Additional embodiments are set forth in part in the description that follows, and will become apparent to those skilled in the art upon examination of the specification and may be learned by practice of the disclosed subject matter. A further understanding of the nature and advantages of the present disclosure may be realized by reference to the remaining portions of the specification and the drawings, which form a part of this disclosure. One of skill in the art will understand that each of the various aspects and features of the disclosure may advantageously be used separately in some instances, or in combination with other aspects and features of the disclosure in other instances.

DETAILED DESCRIPTION

A roof ventilation system is disclosed herein. The roof ventilation system generally includes an elongated vent body defining a channel, with a support member received in the channel. The roof ventilation system further includes a securing feature for securing the roof ventilation system to the roof deck. In some embodiments, the securing feature may comprise a flange extending from each side of the body and configured to engage with the roof deck. In other embodiments, the securing feature may comprise a plurality of integral tabs extending from each side of the elongated body.

The roof ventilation system described herein allows for easier installation of the ventilation system on a roof. For example, the roof ventilation system may be installed without mortar and may be installed without the installation of individual brackets to separately secure the ridge board above the ridge slot. For example, the elongated vent body may be single piece construction. Further, the securing feature may attach directly to the roof deck and may be integrally formed with the elongated vent body. Such integral formation may allow the roof ventilation system to be installed as a single piece, reducing labor and time spent on installation, as well as potentially reducing costs associated with installation of the vent. The roof ventilation system may further act as a structural member to support the weight of the cap roof tile while also providing for sufficient airflow for venting the attic. The roof ventilation system may further be either partially or completely concealed by various elements of the tile roof, providing a more aesthetically pleasing solution for ventilation of such roofs. In some examples, the roof ventilation system may include integral tabs for attachment of the tile roof ridge vent to a roof. Such integral tabs may reduce or eliminate oil canning and deformation of the vent shape while further accommodating installation of the tile roof ridge vent on roofs of various slopes. Other advantages of the various embodiments of the tile roof ridge vent will become apparent with reference to the description and figured provided with the disclosure.

Figure 1A:
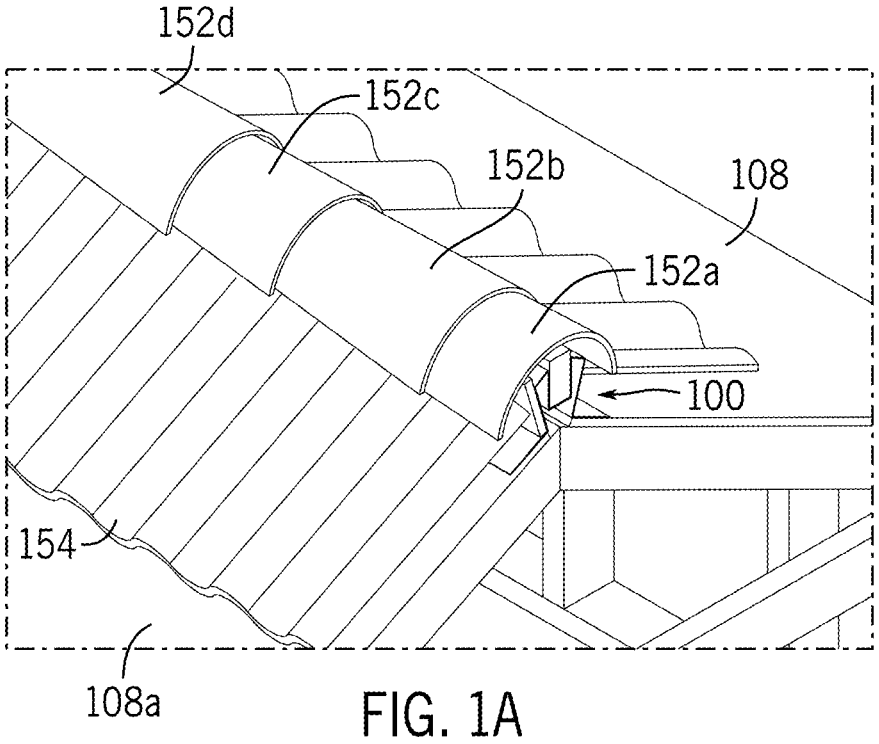
FIG. 1A is a perspective view of a first embodiment of a tile roof ridge vent installed on a tile roof.
Figure 1B:
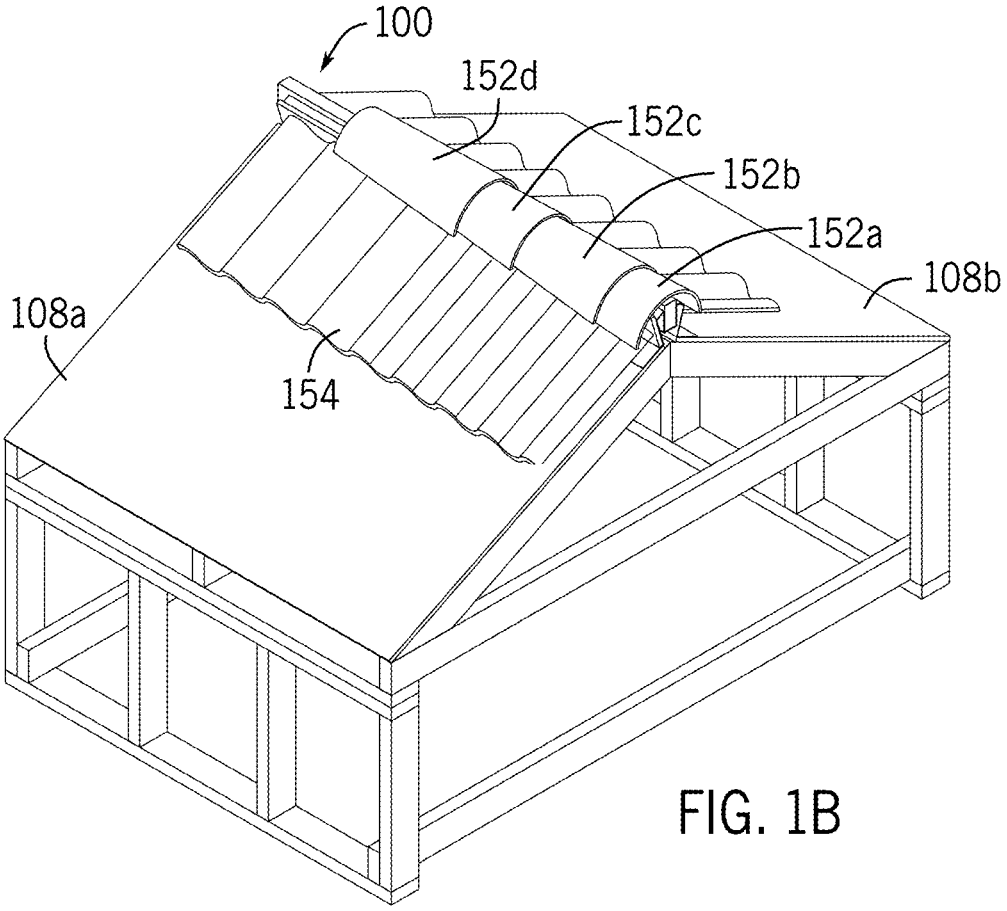
FIG. 1B is an additional perspective view of the first embodiment of the tile roof ridge vent installed on the tile roof.

As shown in FIGS. 1A and 1B, the tile roof ridge vent 100 may be designed for installation with a tile roof. For example, the tile roof ridge vent 100 shown in FIG. 2B, the tile roof ridge vent 100 may include securing features (e.g., integral or integrated tabs) 102*a*-102*n* extending from either side of an elongated vent body 104. The integral tabs 102*a*-102*n* may generally be integrally formed with the elongated vent body 104 (e.g., the elongated vent body 104 and the integral tabs 102*a*-102*i* may be formed from one piece of material). The elongated bent body 104 may be installed over a ridge 106 of the roof, while the integral tabs 102*a*-102*n* may be configured to secure the tile roof ridge vent 100 to decks 108*a* and 108*b* of the roof. In various examples, the elongated body 104 may further be shaped to receive a ridge board 110. Other embodiments of the tile roof ridge vent may include similar features. For example, the tile roof ridge vent 200 shown in FIGS. 3A and 3B may include a securing feature comprising flanges 202*a* and 202*b* integrally formed with an elongated vent body 204. The elongated vent body 204 may be shaped to receive a ridge board 210. Similarly, the tile roof ridge vent 300 shown in FIGS. 5A-5D generally includes an elongated vent body 304 and a securing feature comprising integral tabs 302*a*-302*f* integrally formed with the elongated vent body 304. The elongated vent body 304 may be shaped to receive a ridge board 310.

Figure 7:
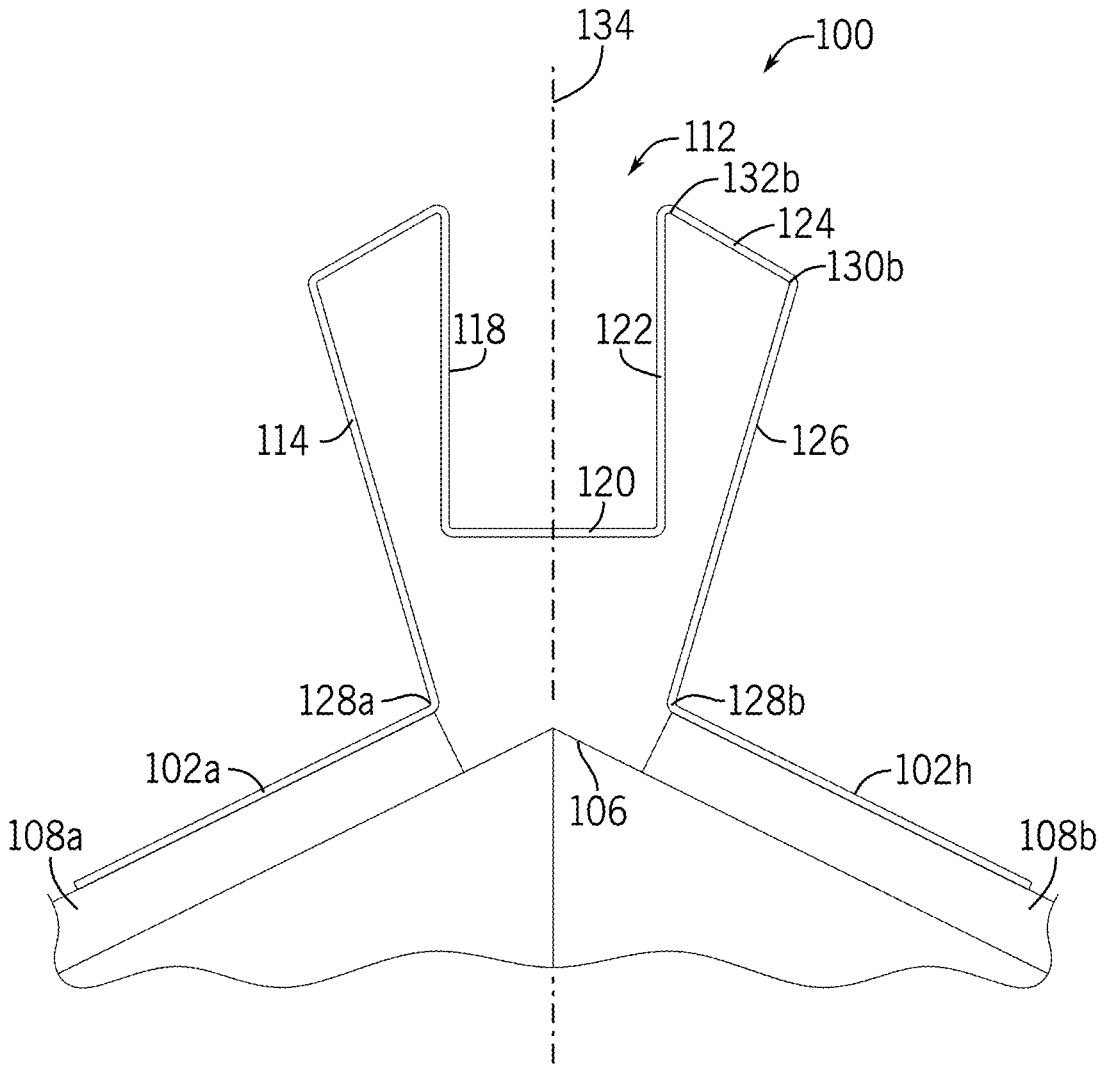
FIG. 7 is a front view of the first embodiment of the tile roof ridge vent.

As shown in FIG. 7, the elongated vent body 104 may generally include a channel 112 shaped to receive a ridge board 110, a portion 114 extending upward relative to the roof deck 108*a*, a portion 116 extending between the portion 114 and a first side 118 of the channel 112, a bottom 120 of the channel, a second side 122 of the channel extending between the bottom 120 of the channel 112, and portion 124 extending between the second side 122 of the channel 112 and a portion 126 of the elongated vent body 104. The portion 126 of the elongated vent body 104 may extend upward relative to the roof deck.

Figure 8:
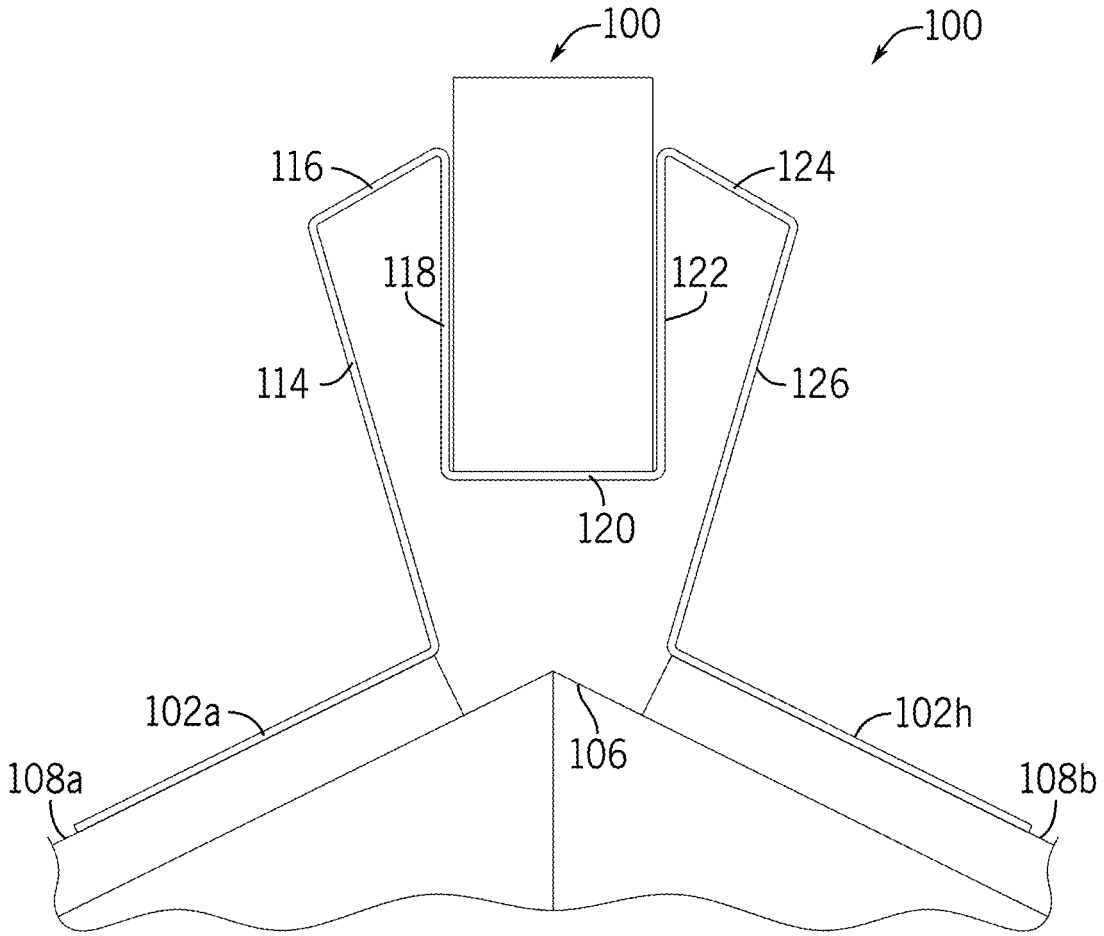
FIG. 8 is a front view of the first embodiment of the tile roof ridge vent including a ridge board.

The elongated vent body 104 may generally be symmetrical about a central axis 134, which may be approximately parallel to the ridge 106 of the roof. For example the central axis 134 may extend through the bottom 120 of the channel 112 (e.g., at a point halfway between the first side 118 of the channel 112 and the second side 122 of the channel 112). The first side 118 of the channel 112 may extend upward from the bottom 120 of the channel 112 at an angle 136*a* and the second side 122 of the channel 112 may extend upward from the bottom 120 of the channel at an angle 136*b*. The angles 136*a* and 136*b* may be the same (e.g., forming 90 degree angles between the bottom 120 of the channel 112 and the respective sides 118 and 122 of the channel 112). The sides 118 and 122 of the channel 112 may generally be the same height. The channel 112 may generally be shaped to receive a ridge board 110. For example, as shown in FIG. 8, the ridge board 110 may be rectangular and may rest on the bottom 120 of the channel 112, with the sides 118 and 122 of the channel 112 contacting the ridge board 110 and/or holding the ridge board 110 in a desired position. The ridge board 110 may, in various examples, extend upward from the channel 112 (e.g., past a point where the first side 118 of the channel 112 meets the portion 116 of the elongated body 104 and a point where the second side 122 of the channel 112 meets the portion 124 of the channel 112.

With reference to FIG. 7, the portions 114 and 126 of the channel 112 may similarly extend from the securing features (e.g., integral tabs 102*a* and 102*i*, respectively) at angles 128*a* and 128*b*. The angles 128*a* and 128*b* may generally be the same. In various examples, the angles 128*a* and 128*b* may be between 70-110 degrees. The portions 114 and 126 of the elongated vent body 104 may generally be the same height (e.g., a distance between the integral tab 102*a* and portion 116 of the elongated vent body 104 may be the same as a distance between the integral tab 102*i* and the portion 124 of the elongated vent body 104. The portions 116 and 124 may extend from the portions 114 and 126 of the elongated vent body 104, respectively, forming an angle 130*a* between the portions 114 and 116 and an angle 130*b* between the portions 126 and 124 of the elongated vent body 104. The angles 130*a* and 130*b* may generally be the same. In various examples, the angles 130*a* and 130*b* may be between 70-110 degrees.

The portions 116 and 124 of the elongated vent body 104 may extend between the portion 114 of the elongated vent body 104 and the first side 118 of the channel 112 and the portion 126 of the vent body 104 and the second side 122 of the channel 112, respectively. The portions 116 and 124 of the elongated vent body 104 may generally be the same size (e.g., extending the same distance between the portion 114 and the first side 118 of the channel 112 and the portion 126 and the second side 122 of the channel 112, respectively). Angles 132*a* and 132*b* between the portion 116 and the first side 118 of the channel 112 and the portion 124 and the second side 122 of the channel 112 may be the same. In various examples, the angles 132*a* and 132*b* may be between 30-90 degrees.

In various examples, a depth of the channel 112 (e.g., a height of the first side 118 of the channel 112 and the second side 122 of the channel 112) may be chosen according to a height of cap tiles anticipated for use with the tile roof ridge vent 100. For example, with reference to FIG. 8, the depth of the channel may affect a height of the ridge board 110 (e.g., how far past the portions 116 and 124 the ridge board 110 extends). As the ridge board 110 generally supports cap tiles, this distance may change for various shapes and/or sizes of cap tiles. For example, the ridge board 110 may extend further past the portions 116 and 124 to support cap tiles with larger diameters. The ridge board 110 may extend less past the portions 116 and 124 to support cap tiles with smaller diameters.

Figure 4A:
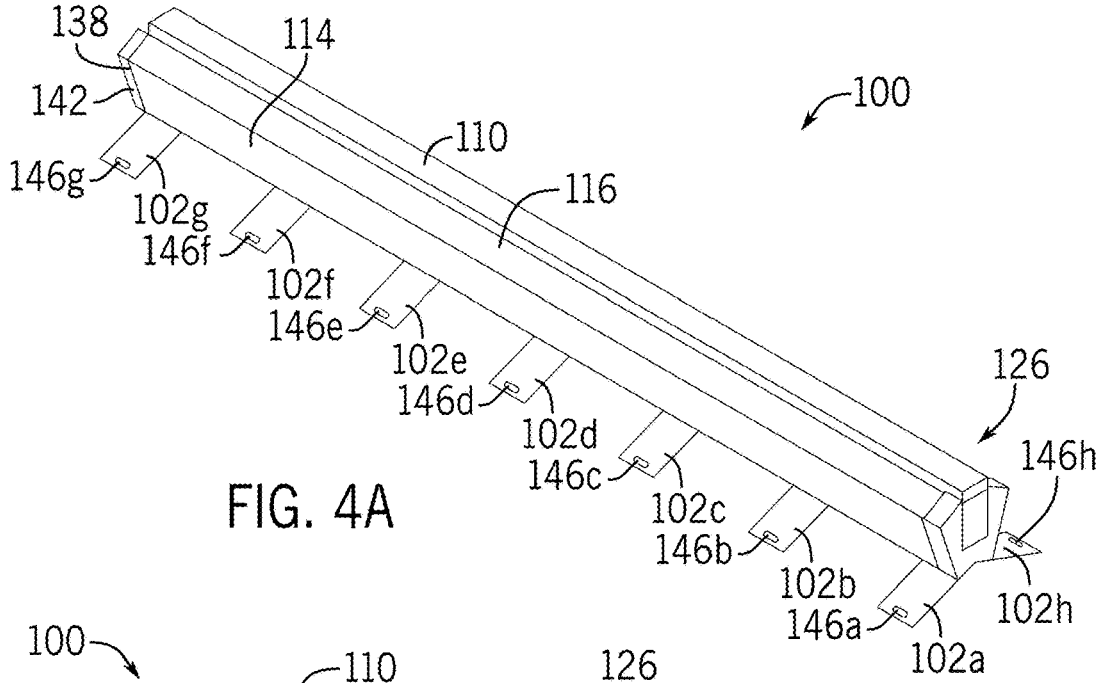
FIG. 4A is a perspective view of the first embodiment of the tile roof ridge vent.
Figure 4B:
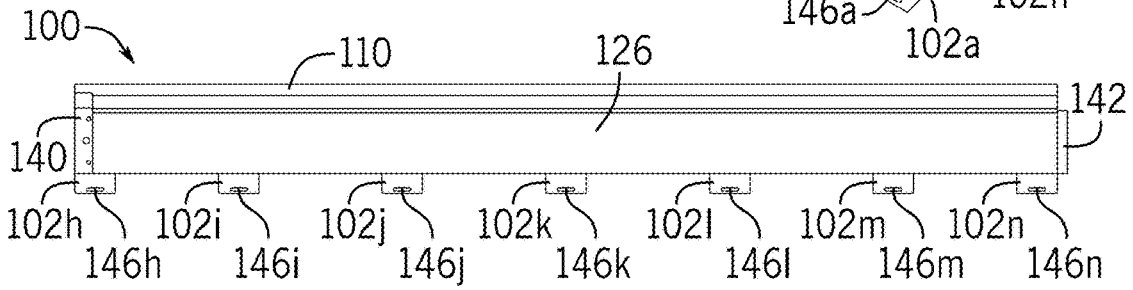
FIG. 4B is a right side view of the first embodiment of the tile roof ridge vent.
Figure 4C:
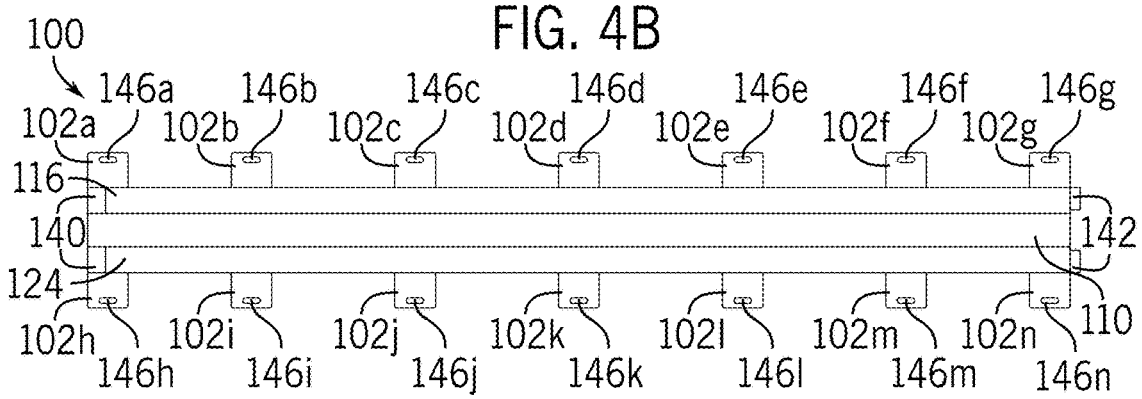
FIG. 4C is a top view of the first embodiment of the tile roof ridge vent.
Figure 4D:
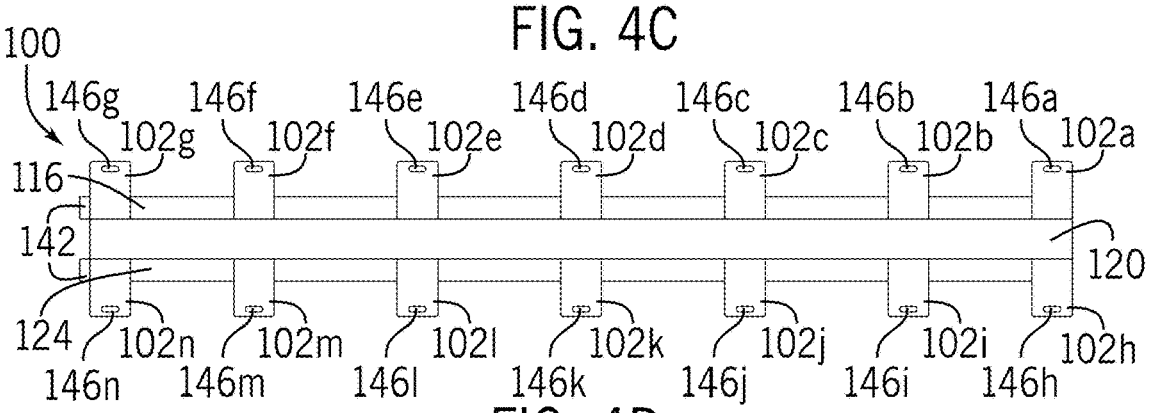
FIG. 4D is a bottom view of the first embodiment of the tile roof ridge vent.
Figure 5A:
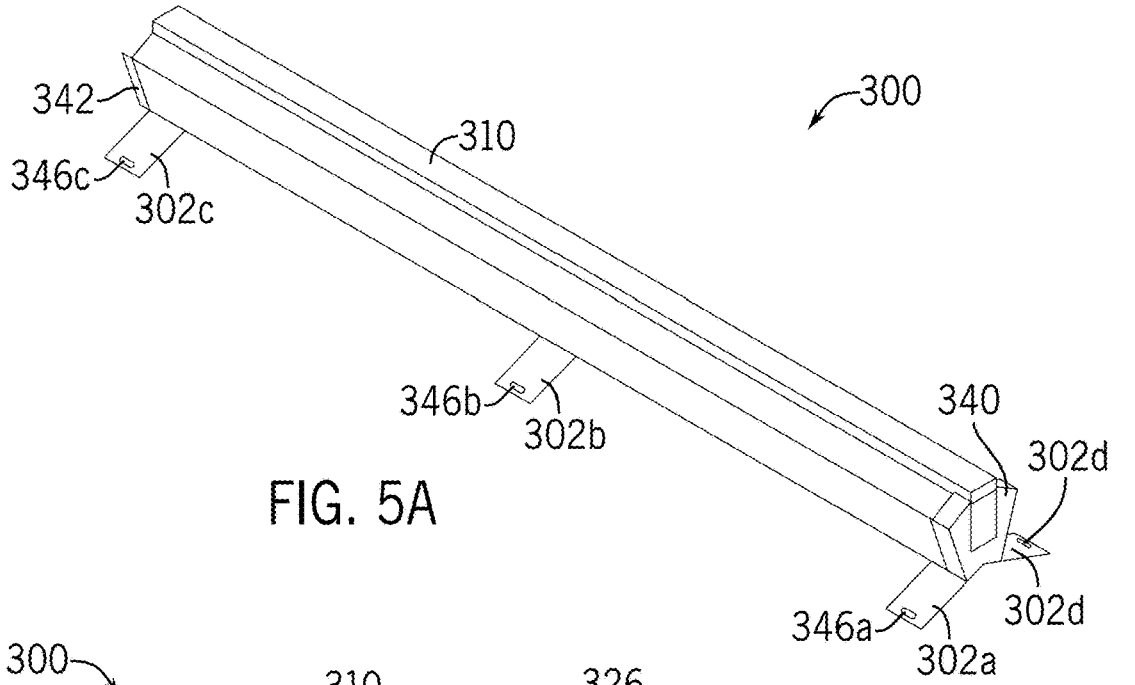
FIG. 5A is a perspective view of a third embodiment of a tile roof ridge vent.
Figure 5B:
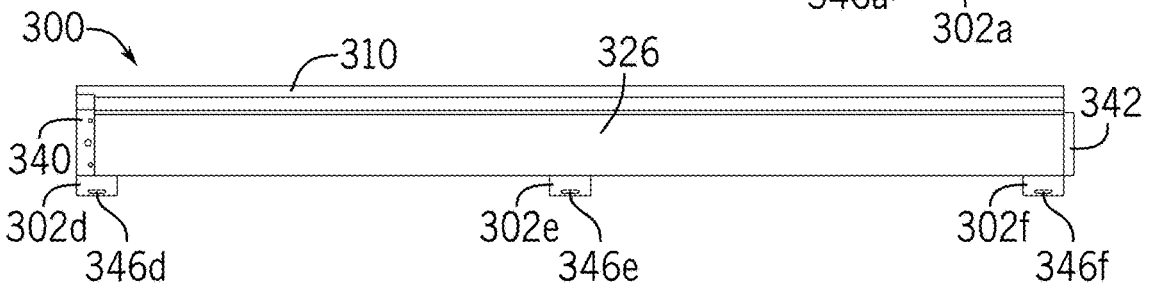
FIG. 5B is a side view of the third embodiment of the tile roof ridge vent.
Figure 5C:
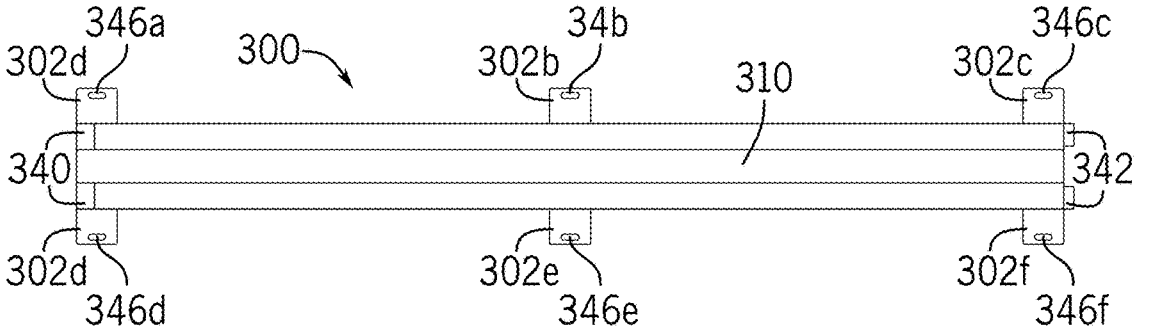
FIG. 5C is a top view of the third embodiment of the tile roof ridge vent.
Figure 5D:
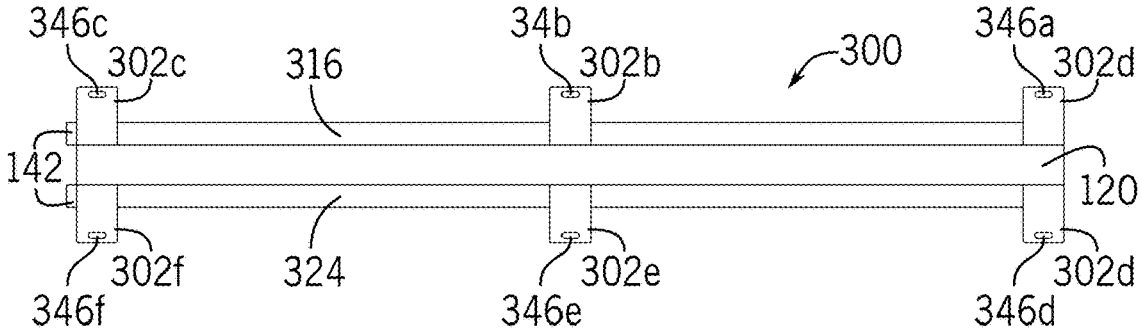
FIG. 5D is a bottom view of the third embodiment of the tile roof ridge vent.

With reference to FIG. 4A, each of the portions 114, 116, 124, and 126 of the elongated vent body 104 may extend along a length 134 of the elongated vent body 104, extending between a front edge 136 and a rear edge 138 of the elongated vent body 104. Similarly, with reference to FIG. 4D, each of the first side 118, the bottom 120, and the second side 122 of the channel 112 may extend along the length 134 of the elongated vent body 104. Further, with reference to FIGS. 4A-4D, in various examples, the elongated vent body 104 may include end caps 140 and 142, contacting the edges 136 and 138 of the elongated vent body 104, respectively, enclosing the elongated vent body 104.

Figure 6:
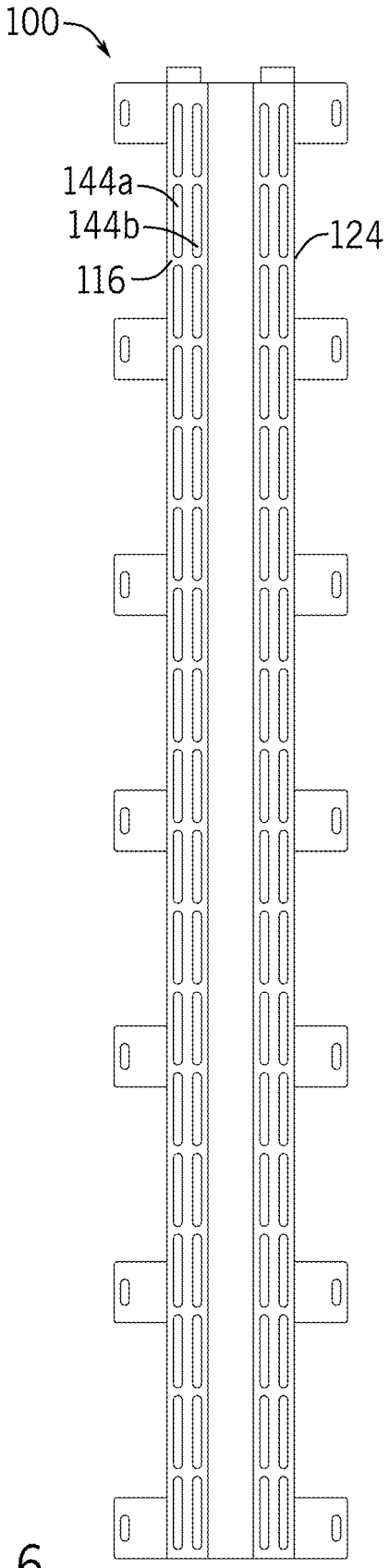
FIG. 6 is a top view of the first embodiment of the tile roof ridge vent.

With reference to FIG. 6A, in various examples, the portions 116 and 124 of the elongated vent body 104 may include openings or apertures (e.g., apertures 144*a* and 144*b* in the portion 116) to provide ventilation through the tile roof ridge vent 100. The apertures 144*a* and 144*b* may extend through the portion 116 of the elongated vent body 104. Though the apertures 144*a* and 144*b* are shown shaped as rectangular with rounded edges, apertures may be shaped differently in various examples, such as circular, oval, or other shapes. Apertures may be placed along the entire length and width of the portions 116 and 124 of the elongated vent body 104. For example, as shown in FIG. 6A, two columns of apertures may extend along the length of each of the portions 124 and 116 of the elongated vent body 104. The apertures may provide sufficient airflow (e.g., airflow from outside of the tile roof ridge vent 100 to an interior space such as an attic) for ventilation of the interior space. For example, in one embodiment, the vent may have a minimum 15.5 square feet per lineal foot of net free area (NFA).

Elongated vent bodies 204 and 304 may be implemented using similar methods and features as those described with respect to the elongated vent body 104. For example, each of the vent bodies 204 and 304 may include channels 212 and 312, respectively, and may include portions analogous to the portions 114, 116, 124, and 126 of the elongated vent body 104. The channels 212 and 312 may be formed of sides analogous to sides 118 and 122 and a bottom analogous to the bottom 120 of the channel 112.

Securing features may generally extend from the elongated vent bodies 104, 204, and 304 of the tile roof ridge vents 100, 200, and 300, respectively. The securing features may comprise integrated tabs, flanges, or other features in various examples. As shown, for example, in FIGS. 3A-3B, the securing features may be flanges 202*a* and 202*b* extending from respective portions 216 and 224 of the elongated vent body 204. The flanges 202*a* and 202*b* may be rectangular in shape, extending along the length 234 of the tile roof ridge vent 200. In various examples, the flanges 202*a* and 202*b* may include additional features, such as apertures extending through the flanges 202*a* and 202*b* for securing the tile roof ridge vent to decks 208*a* and 208*b* of the roof, respectively. For example, the apertures may be configured to receive various fasteners (e.g., nails or screws) for securing the tile roof ridge vent 200 to the decks 208*a* and 208*b*.

With respect to FIGS. 4A-4D, the tile roof ridge vent 104 may include integral tabs 102*a*-102*g* extending from portion 114 of the elongated vent body 104 and integral tabs 102*h*-102*n* extending from portion 126 of the elongated vent body 104. The integral tabs 102*a*-102*g* may be roughly rectangular in shape and may extend outward from the surface 116 of the elongated vent body 104. The integral tabs 102*a*-102*g* may further be evenly spaced along the length 134 of the tile roof ridge vent 100. The integral tabs 102*h*-102*n* may similarly extend from the portion 124 of the elongated vent body, and may be similarly evenly spaced along the length 134 of the tile roof ridge vent 100. The integral tabs 102*a*-102*n* may include apertures 146*a*-146*n* extending through the integral tabs 102*a*-102*n*, respectively, for securing the tile roof ridge vent 100 to a roof. Though the apertures 146*a*-146*n* are shown as elongated rectangles with rounded edges, the apertures 146*a*-146*n* may, in various examples, be circular, oval, rectangular or otherwise shaped.

As shown in FIGS. 5A-5D, various embodiments of the tile roof ridge vent 300 may include different numbers of integral tabs. For example, the tile roof ridge vent 300 includes integral tabs 302*a*-302*c* extending from a portion 316 of the elongated vent body 304 and integral tabs 302*d*-302*f* extending from a portion 324 of the elongated vent body 304. Other numbers of integral tabs may be included in various other embodiments, such as 4, 5, 6, 7, or other numbers of integral tabs extending from each side of the elongated vent body 304.

Use of integrated or integral tabs may reduce or eliminate oil canning and deformation of vent shape which may occur with larger pieces of material. For example, integrated tabs may be more easily bent by hand (e.g., after manufacturing) to accommodate different roof pitches without deforming the overall shape of the tile roof ridge vent 100. Where a shorter width of material is bent (such as with integrated tabs 102*a*-102*n*), there may be less springback associated with bending of the integrated tabs due to the shorter width of material being bent.

The securing features may generally be integrally formed with the elongated vent bodies. For example, with reference to FIGS. 4A and 4C, the elongated vent body 104 of the tile roof ridge vent 104 and the integral tabs 102*a*-102*n* may be formed of a single piece of material. For example, a single piece of material may be bent during manufacturing to form the surfaces of the elongated vent body and the securing features. In examples where the securing features comprise integrated tabs, the integrated tabs may be formed from the flanges by cutting out portions of steel on the flanges to form the desired number of integrated tabs and apertures extending through the integrated tabs.

As described herein, the channel 112 of the tile roof ridge vent 100 may receive a support member 110. The support member 110 may, in various examples, be made of wood or a composite material. The support member 110 may therefore support cap roof tile as well as provide an attachment point of the cap roof tile to the tile roof ridge vent 100. For example, the cap tiles may be secured to the support member 100 using various fasteners such as nails or screws.

The elongated vent body 104 and the integrated tabs 102*a*-102*n* may be formed from sufficiently thick material to provide adequate rigidity to support weight of cap tiles of the roof and to reinforce the roof. For example, the elongated vent body 104 and the integrated tabs 102*a*-102*n* may be formed of 14, 16, 18 or 20 gauge steel. The elongated vent body 204 and flanges 202*a* and 202*b* may be formed of a similar material. The elongated vent body 304 and integrated tabs 302*a*-302*f* may be formed of a similar material.

In various examples, the elongated vent body 104 and the integrated tabs 102*a*-102*n* may be manufactured by bending a single piece of material to form each of the portions of the elongated vent body 104, the channel of the vent body 112, the integrated tabs 102*a*-102*n*, and the angles between the various surfaces. The tile roof ridge vents 200 and 300 may be similarly formed. Where the securing feature includes integrated tabs (e.g., integrated tabs 102*a*-102*n* or integrated tabs 302*a*-302*f*, flanges formed in the initial bending process may be modified to create the integrated tabs. For example, integrated tabs may be formed by cutting out portions of material on the attachment flanges, leaving behind a desired number of integrated tabs.

In various examples, a nonwoven material (e.g., nonwoven material 150 shown in FIGS. 2A-2B or nonwoven material 250 shown in FIGS. 3A-3B) may be applied to an outer portion of a tile roof ridge vent. For example, with reference to FIG. 2B, nonwoven material 150 may be applied to portion 114 of the elongated vent body 104. In some examples, nonwoven material may further be applied to portion 126 of the elongated vent body 104. Such nonwoven material 150 may be attached to the elongated vent body 104 using adhesive and/or fasteners. The nonwoven material 150 may hinder or prevent the ingress of snow, dust, dirt, snow, insects, and moisture into the interior space (e.g., attic) being vented by the tile roof ridge vent 100. The nonwoven material 150 may be installed contacting both the integral tabs 102*a*-102*g* and the portion 114 of the elongated vent body 104 or, in some examples, may be attached such that the nonwoven material 150 contacts the portion 114 of the elongated vent body 104 without contacting the integral tabs 102*a*-102*g*. Such installation may provide a space for field roof tile to directly contact the tile roof ridge vent 100 (e.g., contacting the portion 114 of the elongated vent body 104 between the integral tabs 102*a*-102*g* and the nonwoven material 150) to provide an additional impediment to water migrating under the field tile and creeping up the side of the tile roof ridge vent and into the ventilated interior space.

In various examples, mesh may be provided over apertures (e.g., apertures 144*a* and 144*b* shown in FIG. 6A) in portions 116 and/or 124 of the elongated vent body 104. Such mesh may be riveted or otherwise attached to portions 116 and/or 124 and may prevent ingress of embers and other large particles into the interior ventilated area through such apertures. Similar mesh may be provided on the tile roof ridge vent 200 and/or the tile roof ridge vent 300.

Figure 2A:
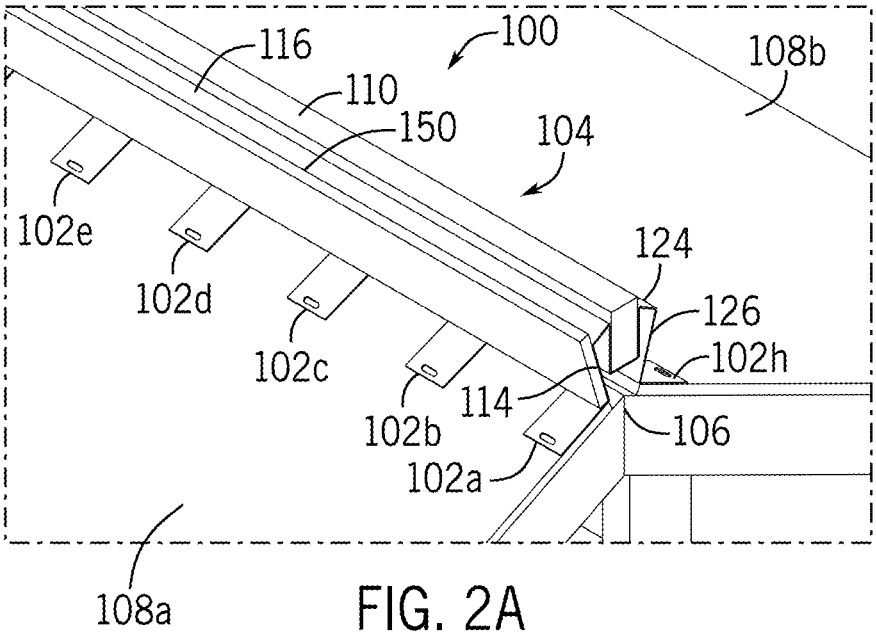
FIG. 2A is a perspective view of the first embodiment of the tile roof ridge vent mounted on a roof deck.
Figure 2B:
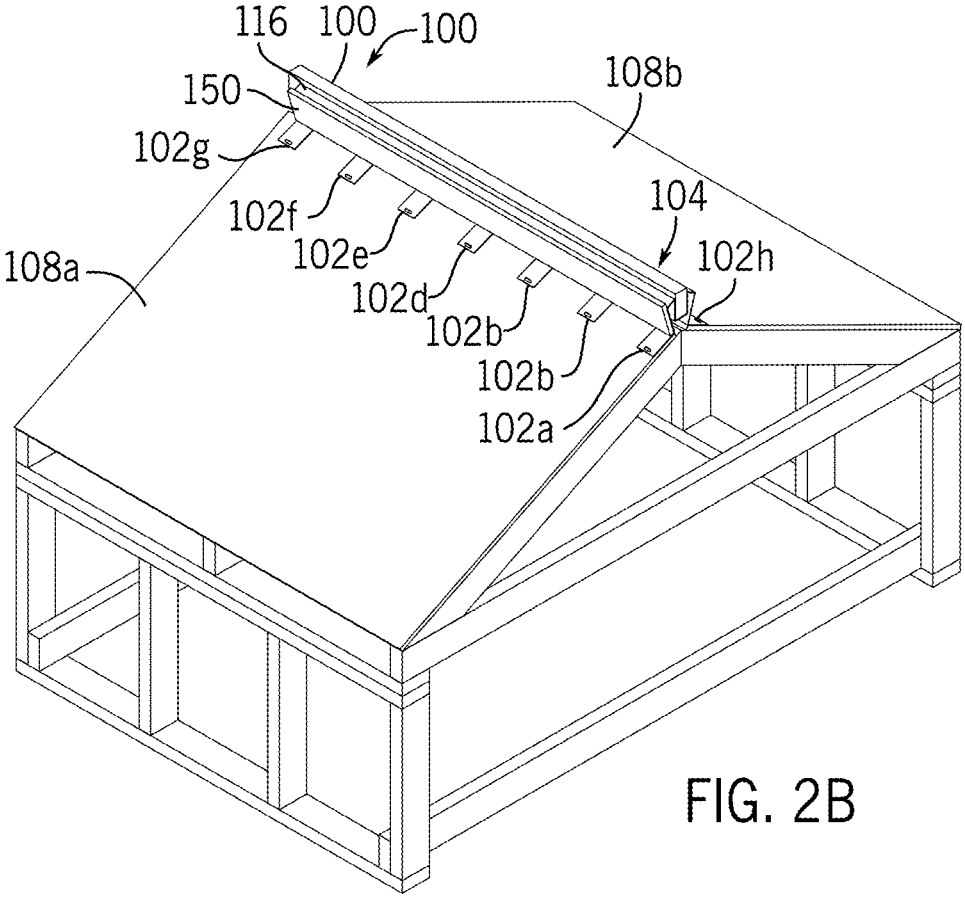
FIG. 2B is an additional perspective view of the first embodiment of the tile roof ridge vent mounted on the roof deck.
Figure 3A:
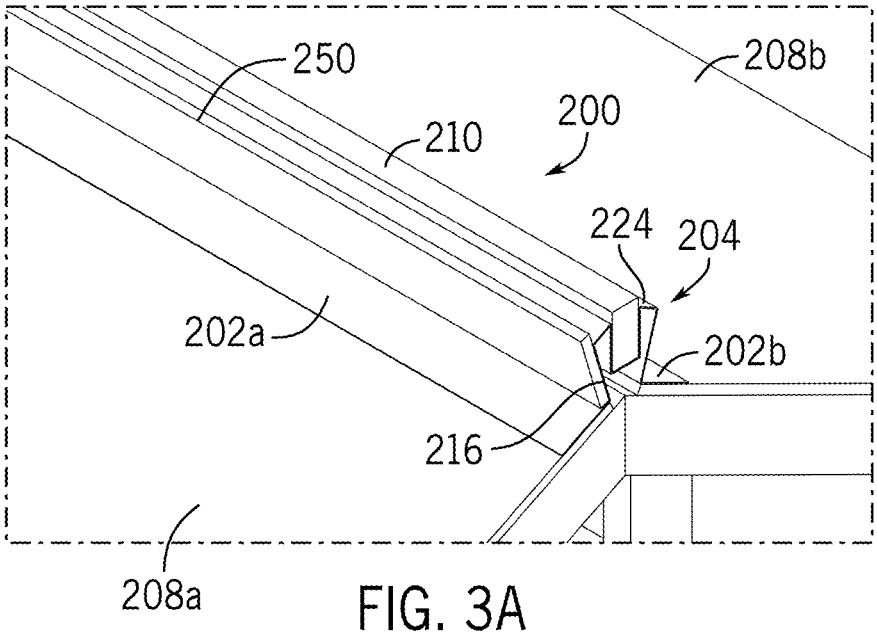
FIG. 3A is a perspective view of a second embodiment of a tile roof ridge vent mounted on a roof deck.
Figure 3B:
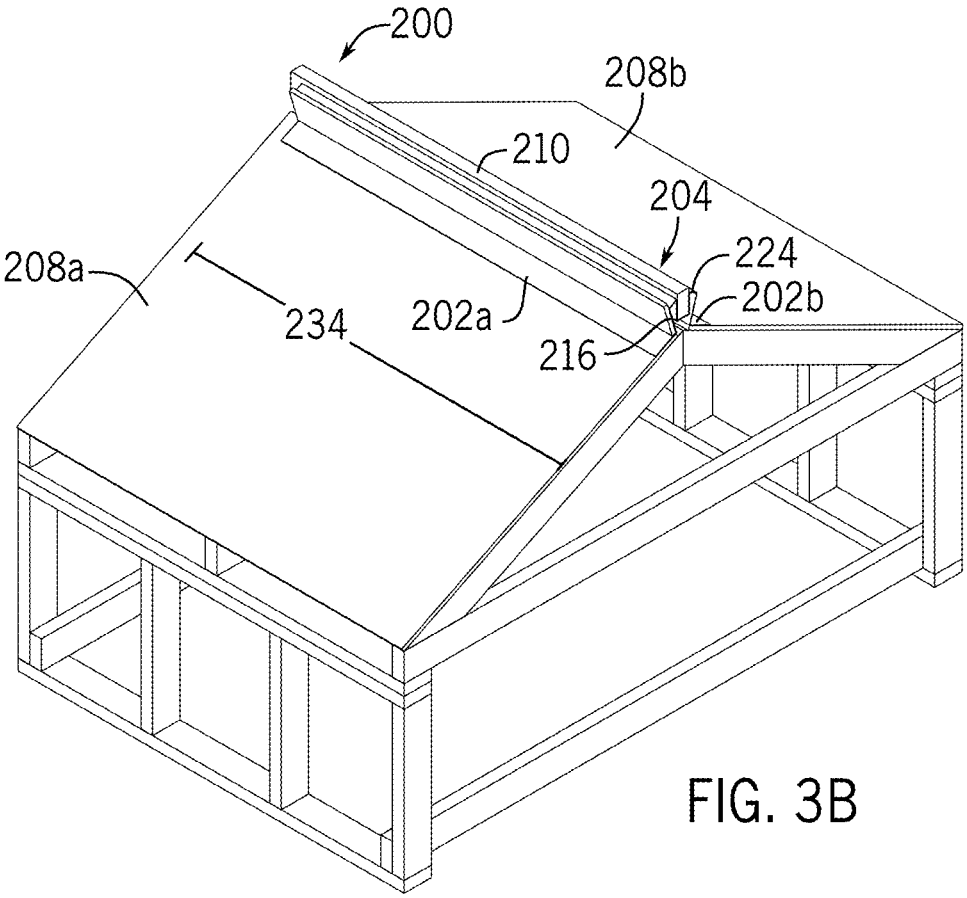
FIG. 3B is an additional perspective view of the second embodiment of the tile roof ridge vent mounted on the roof deck.

With reference to FIGS. 2A and 2B, the tile roof ridge vent 100 may be installed on a roof by securing integrated tabs 102*a*-102*g* to roof deck 108*a* and securing integrated tabs 102*h*-102*n* to roof deck 108*b*. In various examples, the integrated tabs 102*a*-102*n* may, prior to installation, be configured according to pitch of the roof decks 108*a* and 108*b*. For example, during manufacturing or prior to installation, the integrated tabs 102*a*-102*n* may be bent to allow installation of the tile roof ridge vent 100 on a certain roof pitch. For example, the angles 128*a* and 128*b* (shown in FIG. 7) may be adjusted to match a pitch of the roof decks 108*a* and 108*b*. Integrated tabs 302*a*-302*f* may be similarly bent to allow installation of the tile roof ridge vent 300 on various roof pitches. Flanges 202*a* and 202*b* may be similarly bent to allow installation of the tile roof ridge vent 200 on various roof pitches.

The tile roof ridge vent 100 may be secured to roof decks 108*a* and 108*b* using fasteners extending through apertures 146*a*-146*n* of the integral tabs 102*a*-102*n* and into the roof decks 108*a* and/or 108*b*. Such fasteners may include, in various examples, screws or nails. Different types of fasteners may be used in different environments. For example, screws may be used in areas prone to high winds or other extreme weather (such as hurricanes) to improve structural integrity of the roof in such events. The tile roof ridge vents 200 and 300 may be similarly attached to roofs for installation. Once the tile roof ridge vent 100 is secured to the roof deck 108*a* and the roof deck 108*b*, the ridge board 110 may be placed in the channel 112 of the elongated vent body 104 of the tile roof ridge vent 100.

In some embodiments, the roof ridge vent 100 may include an adjustment feature that allows the supported ridge board 110 to be raised or lowered with the adjustment of fasteners. For example, the supported ridge board 110 may be raised or lowered with the adjustment of two fasteners located in the channel 112. In one example, adjustment screws may be located in the bottom of the channel and may include a built-in washer providing a flange extending beyond the head of the washer and positioned above a shank or threaded area of the adjustment screw. The screw may thread into the wood positioned in the channel through a clearance hole large enough to receive the shank but smaller than the diameter of the integral washer. Another piece of metal without a clearance hole with a diameter large enough to receive the head of the fastener but with a smaller hole than the integral washer may be attached (e.g., by rivet, weld, toggle lock, or some other means) under the channel and over the head of the adjusting screw. Another adjusting screw may be positioned similarly with similar fasteners. With the integral fastener captured between the two pieces of metal the counterclockwise turning of the fastener raises the supported ridge board to adjust clearance for lower slopes or lowers the supported ridge board for steeper slopes. Such adjustments may further provide adjustments for a variety of cap tiles and field tiles, including different cap tile radiuses, cap tile heights and thicknesses, and shapes and geometries of cap tiles and field tiles.

The adjustment feature addresses potential gapping that may be caused by installing vents on various roof pitches. For example, the end or tip of a roof cap tile may be varying distances from the field tile depending on slope of the roof. In a steeper slope installation, this may cause a large gap from the bottom of the roof cap tile to the field tile. In a lower slope installation, the cap tile may impinge the field tile before the mechanical or other fastening of the cap tile to the ridge board is fully seated. The adjustment feature may solve the potential seating issue by adjusting the distance between the bottom of the roof cap tile and the top of the field tile. The adjustable supported ridge board 110 may also address potential issues caused by use of the roof ridge vent 100 with various diameters, heights, and shapes of various roof cap tiles combined with various shapes and heights of field tiles. For example, the adjustment feature allows for adjustment of the gap between the end of the roof cap tile and the field tile within a range of cap tile diameters, heights, and shapes along with various field tile shapes and sizes, including both flat and barrel types.

With reference to FIGS. 1A and 1B, after the tile roof ridge vent 100 is secured to the roof deck 108*a* and the roof deck 108*b*, tiles of the roof may be installed around the tile roof ridge vent. For example, field tiles 154 may be installed on the roof deck 108*a* and field tiles 156 may be installed on roof deck 108*b*. Cap tiles 152*a*-152*d* may then be installed over the tile roof ridge vent 100. When installed, the supported ridge board 110 may support weight of the cap tiles. In some examples, the cap tiles may be secured to the supported ridge board 110 using various fasteners. Where the tiled roof ridge vent 100 includes an adjustment feature for the supported ridge board 110, the height of the ridge board 110 may be adjusted to match a height or other characteristic of the cap tiles 152*a*-152*d* before installation.

As shown in FIGS. 1A and 1B, after installation, the tile roof ridge vent 100 may hidden from view, providing a more aesthetically pleasing venting solution for tile roofs. For example, the tile roof ridge vent 100 may be mostly or entirely obscured view by cap tiles 152*a*-152*d* installed over the ridge of the roof. Further, as described herein, installation of the tile roof ridge vent 100 may be easier compared to existing venting solutions, as the tile roof ridge vent may be formed from a single piece of material and, accordingly, may use fewer components for installation and/or may not use components for attaching different portions of the vent to one another. In examples, where the tile roof ridge vent 100 includes integrated tabs 102*a*-102*n*, the tile rood ridge vent 100 may further accommodate various different roof pitches, as the integrated tabs 102*a*-102*n* may be relatively easily bent to allow installation of the tile roof ridge vent 100 on roofs having differing slopes. Accordingly, manufacturing and supply chain logistics are simplified, as different vents do not need to be manufactured for different roof slopes.

All relative and directional references (including: upper, lower, upward, downward, left, right, leftward, rightward, top, bottom, side, above, below, front, middle, back, vertical, horizontal, and so forth) are given by way of example to aid the reader's understanding of the particular examples described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed examples teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

The invention claimed is:

1. A ventilation system for a tile roof, the ventilation system comprising: an elongated vent body defining a channel extending along a length of the elongated vent body; securing features integrated with and extending from each side of the elongated vent body, the securing features being configured to engage with a roof deck of the tile roof, wherein the securing features comprise a first plurality of securing features and a second plurality of securing features, the first plurality of securing features extending from a first side of the elongated vent body in a first spaced relationship along the length of the elongated vent body, the second plurality of securing features extending from a second side of the elongated vent body in a second spaced relationship along the length of the elongated vent body; and a support member received in the channel of the elongated vent body; wherein the elongated vent body is an integral V shaped body with a base; wherein no elements are formed between the V shaped body and the securing features; wherein the support member is substantially received within the channel of the V shaped body; and wherein the support member extends in the entire length of the elongated vent body.

2. The ventilation system of claim 1, wherein the securing features comprise a plurality of integral tabs extending from each side of the elongated vent body.

3. The ventilation system of claim 1, wherein with elongated vent body is a single piece construction.

4. The ventilation system of claim 1, further comprising a nonwoven material engaged with the elongated vent body and spaced away from the securing features.

5. The ventilation system of claim 1, further comprising one or more apertures defined in the elongated vent body and a material provided over the one or more apertures and configured to prevent ingress of particles through the one or more apertures.

6. The ventilation system of claim 1, wherein the ventilation system is at least partially concealed by a roof tile and a roof cap.

7. The ventilation system of claim 1, wherein the ventilation system is completely concealed by a roof tile and a roof cap.

8. The ventilation system of claim 1, wherein the support member is a wood or a composite material.

9. The ventilation system of claim 1, wherein the elongated vent body comprises sidewalls extending along the length of the elongated vent body, and wherein the securing features are attached directly to the sidewalls.

10. The ventilation system of claim 2, wherein the plurality of integral tabs includes at least three tabs extending from each side of the body and each configured to receive a fastener to engage with the roof deck.

11. The ventilation system of claim 5, wherein the material is a mesh.

12. A method of manufacturing a ventilation system for a tile roof, the method comprising: deforming a single piece of material to form an elongated vent body defining a channel extending along the length of the elongated vent body; forming, from the single piece of material, securing features extending from each side of the elongated vent body, the securing features being configured to engage with a roof deck, wherein the securing features comprise a first plurality of securing features and a second plurality of securing features, the first plurality of securing features extending from a first side of the elongated vent body in a first spaced relationship along the length of the elongated vent body, the second plurality of securing features extending from a second side of the elongated vent body in a second spaced relationship along the length of the elongated vent body; and placing a support member within the channel of the elongated vent body; wherein the elongated vent body is an integral V shaped body with a base; wherein no elements are formed between the V shaped body and the securing features; wherein the support member is substantially received within the channel of the V shaped body; and wherein the support member extends in the entire length of the elongated vent body.

13. The method of claim 12, wherein forming the securing features comprises bending the single piece of material to create respective flanges extending from the elongated vent body.

14. The method of claim 12, further comprising:

determining a depth of the channel based at least on characteristics of one or more tiles of the tile roof, wherein deforming the single piece of material to form an elongated vent body comprising a channel comprises forming the channel based on the depth of the channel.

15. The method of claim 13, wherein the securing features comprise a plurality of integral tabs extending from each side of the elongated vent body, the method further comprising:

removing material from the respective flanges, leaving the plurality of integral tabs extending from each side of the elongated vent body.

16. The method of claim 13, further comprising:

providing a plurality of apertures in the respective flanges, the plurality of apertures configured to receive a respective plurality of fasteners to engage the respective flanges with the roof deck.

17. The method of claim 15, further comprising:

bending each of the plurality of integral tabs at an angle from the elongated vent body, the angle being determined based on a pitch of the tile roof.

18. A ventilation system for a tile roof, the ventilation system comprising: an elongated vent body defining a channel extending along the length of the elongated vent body; a plurality of integral tabs extending from each side of the elongated vent body, the plurality of integral tabs and the elongated vent body being formed from a single piece of material, the plurality of integral tabs comprising a first plurality of integral tabs and a second plurality of integral tabs, the first plurality of integral tabs extending from a first side of the elongated vent body in a first spaced relationship along the length of the elongated vent body, the second plurality of integral tabs extending from a second side of the elongated vent body in a second spaced relationship along the length of the elongated vent body; and a support member received in the channel; wherein the elongated vent body is an integral V shaped body with a base; wherein no elements are formed between the V shaped body and the securing features; wherein the support member is substantially received within the channel of the V shaped body: and wherein the support member extends in the entire length of the elongated vent body.

19. The ventilation system of claim 18, further comprising one or more apertures defined in the vent body.

20. The ventilation system of claim 18, wherein each of the plurality of integral tabs includes an aperture configured to receive a fastener for securing the ventilation system to a roof deck of the tile roof.

21. The ventilation system of claim 18, further comprising a nonwoven material engaged with the elongated vent body.

* * * * *